United States Patent [19]

Frings et al.

[11] Patent Number: 4,639,199

[45] Date of Patent: Jan. 27, 1987

[54] TWO-SHAFT VACUUM PUMP WITH INTERNAL COMPRESSION

[75] Inventors: Heinz Frings; Hans-Peter Kabelitz, both of Cologne; Karl-Heinz Ronthaler, Zulpich, all of Fed. Rep. of Germany

[73] Assignee: Leybold-Heraeus GmbH, Cologne, Fed. Rep. of Germany

[21] Appl. No.: 824,308

[22] Filed: Jan. 30, 1986

Related U.S. Application Data

[63] Continuation of Ser. No. 596,099, Apr. 2, 1984, abandoned.

[30] Foreign Application Priority Data

Apr. 2, 1983 [DE] Fed. Rep. of Germany ..... 3312117

[51] Int. Cl.[4] ..... F04C 18/18; F04C 23/00; F04C 25/02

[52] U.S. Cl. ..... 418/3; 418/9; 418/15; 418/206

[58] Field of Search ..... 418/9, 15, 206, 191, 418/205, 3

[56] References Cited

U.S. PATENT DOCUMENTS

| | | | |
|---|---|---|---|
| 1,818,767 | 8/1931 | Swartwout | 418/206 X |
| 2,129,960 | 9/1938 | Presby | 418/15 X |
| 3,677,664 | 7/1972 | Wycliffe et al. | 418/15 X |
| 3,844,695 | 10/1974 | Weatherston | 418/206 X |
| 3,989,413 | 11/1976 | McGahan et al. | 417/310 |
| 4,068,988 | 1/1978 | Webb et al. | 418/206 |

FOREIGN PATENT DOCUMENTS

| | | | |
|---|---|---|---|
| 9916 | 4/1980 | European Pat. Off. . | |
| 3147824 | 6/1982 | Fed. Rep. of Germany . | |
| 625490 | 6/1949 | United Kingdom | 418/206 |
| 633818 | 12/1949 | United Kingdom . | |
| 2088957 | 6/1982 | United Kingdom . | |
| 794258 | 1/1981 | U.S.S.R. | 418/15 |

OTHER PUBLICATIONS

VDI-Zeitschrift, vol. 91, No. 10, May 10, 1949.

*Primary Examiner*—John J. Vrablik
*Attorney, Agent, or Firm*—Felfe & Lynch

[57] ABSTRACT

A two-shaft vacuum pump which draws gas in at an inlet and compresses it at a first outlet for discharge, thereby producing a vacuum at the inlet, has a second, pressure-responsive outlet from the area where the gas is compressed for discharge from the first outlet. The second outlet thereby relieves excess, compression gas pressure which could overload the pump motor, for example, at the start of operation when high-density gas is drawn in for compression.

18 Claims, 8 Drawing Figures

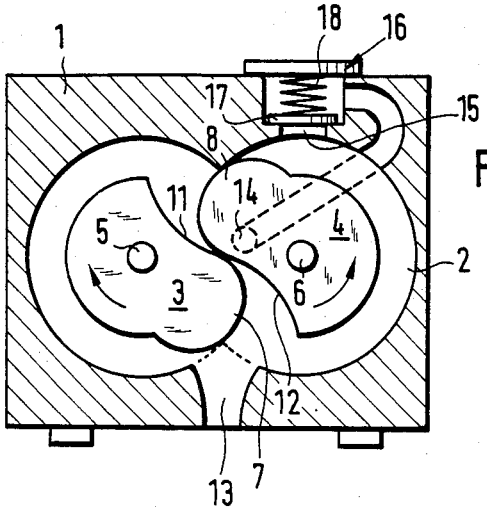
FIG. 1
FIG. 2c
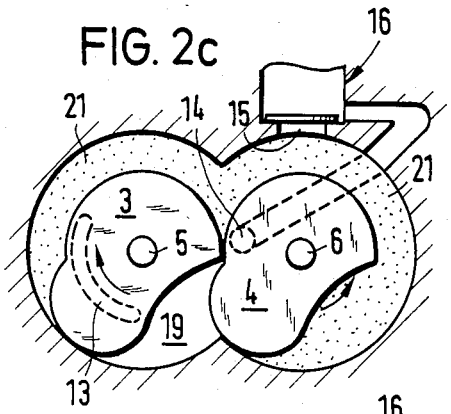
FIG. 2a
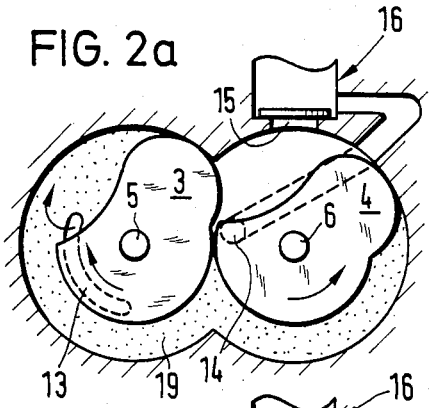
FIG. 2d
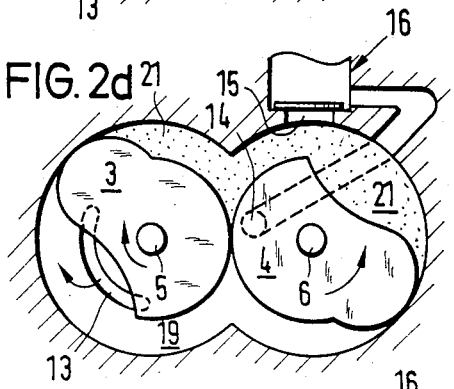
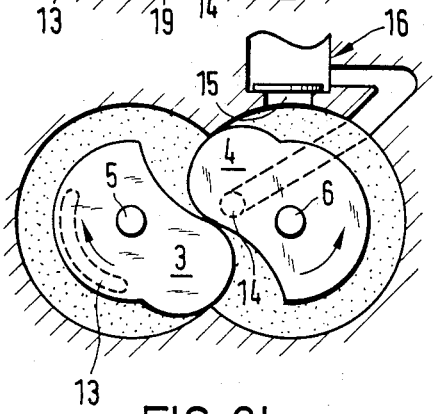
FIG. 2b
FIG. 2e
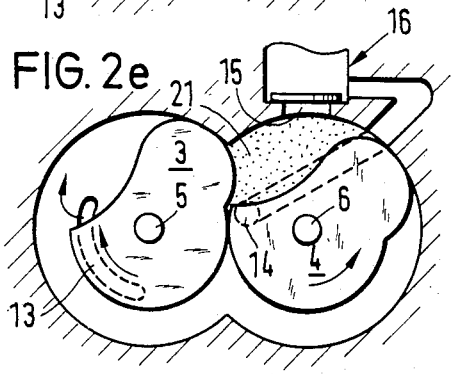

TWO-SHAFT VACUUM PUMP WITH INTERNAL COMPRESSION

This is a continuation of application Ser No. 596,099, filed Apr. 2, 1984 and abandoned herewith.

BACKGROUND OF THE INVENTION

The invention relates to a compression-cycle vacuum pump and, more particularly, to a so-called two-shaft vacuum pump which rotates two rotors disposed in a casing, each rotor having at least one protuberance and at least one indentation for cooperatively pumping gas from an inlet port to an outlet port which is associated with one of the two rotors in such a way that the gases being pumped are compressed.

Two-shaft pumps are known from VDI-Zeitschrift, vol. 91, No. 10, of May 10, 1949, and from European Pat. No. 9916. To be able to handle relatively-high pressure differences when using such a pump as a vacuum pump, provision must be made for appropriately-high internal compression. It is then possible, in principle, to produce pressures in the medium-high vacuum range (to $10^{-3}$ millibars) with a pump of this type which works directly against atmospheric pressure. However, this has the drawback that with high suction pressures (at the start of evacuation, for example) internal supercharging occurs which requires high power consumption by the electric motor driving the rotors. To assure reliable operation, therefore, such a pump would have to be provided with a drive motor of sufficient size for this which would be a disadvantage from the point of view of cost and weight of the pump. If internal supercharging had to be coped with only at the start of evacuation, a smaller electric motor could be used since short-time operation with an overload is permissible. However, prolonged overload operation, as in the event of a sizable leak in the system to be exhausted, would result in destruction of the motor, which is why the motor cannot be made smaller if reliable operation is to be assured.

In another type of two-shaft vacuum pump, the Roots pump, there is no internal compression of the gases being moved. This pump is afflicted with the drawback that, with increasing pressure, the compression ratio is reduced. Below 300 millibars, a Roots pump cannot compress air drawn in to atmospheric pressure. This is why a backing pump (such as a sliding-vane or liquid-piston rotary pump) must be used to compress the air to atmospheric pressure. With such a combination of pumps, pressures extending into the high-vacuum range (to $10-^{5}$ millibars) can be produced. However, pump combinations of this type are complicated and expensive.

SUMMARY OF THE INVENTION

The object of the present invention is to provide a two-shaft vacuum pump of the type outlined at the outset (with internal compression) which is reliable in operation without requiring a drive motor that is oversize for normal pump operation.

In accordance with the invention, this object is accomplished by providing a further outlet port which is equipped with a pressure relief valve. The latter can readily be designed so that internal supercharging in the compression space of the pump is prevented. It is therefore no longer necessary to use an oversize drive motor. Even in continuous operation of the pump with a suction pressure of 1000 millibars, the drive motor will not overload.

DESCRIPTION OF THE DRAWINGS:

Preferred embodiments which are intended to illustrate but not to limit the invention will now be described with reference to drawings in which:

FIG. 1 is a front elevation, partly in section, of a first preferred embodiment;

FIGS. 2*a* to 2*e* are partial, front elevations, partly in section, of a second preferred embodiment in various, successive positions;

FIG. 1 shows a hollow, vacuum pump casing 1 with its intake space 2, in which two rotors 3 and 4 are disposed which wipe against each other. These rotors are mounted on parallel shafts 5 and 6 which are conventionally driven by an electric motor through a synchronizing transmission, neither of which is shown. Each rotor has a protuberance 7 and 8, respectively, and an indentation 11 and 12, respectively. They rotate in the approximately figure-eight intake space 2 in such a way that a suction space and, separated therefrom, a compression space are present at all times. An inlet port 13 which in the embodiment shown in FIG. 3 is disposed peripherally discharges into the suction space. An outlet port 14 is disposed in front end of the casing, i.e. a side of the casing normal to the shafts, in proximity to the annulus which the indentation 12 in the rotor 4 describes at the front end with the outlet port 14. As a result, the opening and closing of the outlet port 14 can be controlled by means of the rotor 4. The degree of internal compression for vacuum pump operation can be determined merely by positioning the outlet port 14.

Figure 3:
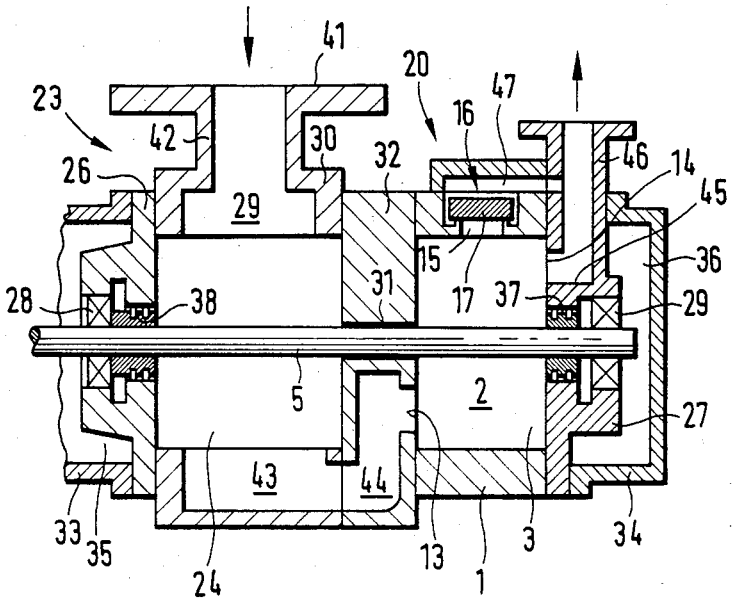
FIG. 3 is a side elevation partly in section, of a third preferred embodiment.

Associated with a further outlet port 15 in the periphery of the casing, i.e. in a side of the casing parallel to the shafts, is a pressure relief valve 16. This pressure relief or bypass valve 16 comprises a valve plate 17 which is subject to the action of a spring 18. The latter is dimensioned so that the additional outlet port 15 opens only when, with relatively high suction or inlet pressures, internal supercharging occurs in the compression space which, in the absence of such a bypass valve, would result in overloading of the drive motor. In other words, the invention functions to accommodate higher inlet pressures by relieving excessive compression pressures.

Shown in FIGS. 2*a* to 2*e* are various positions of the rotors 3 and 4 relative to each other from which the principle of operation of the pump is apparent. In contrast to the embodiment according to FIG. 1, the inlet port 13, like the outlet port 14, is disposed in the front end and is constructed as a slot which is concentric with the shaft 5. Said slot is located in proximity to the annulus which the indentation 11 in the rotor 3 describes at the front end, and the inlet port 13 can therefore be controlled by means of this rotor 3.

FIG. 2*a* shows the rotors in a position in which the inlet port 13 is open and communicates with the suction space 19. After a further, approximately 90-degree rotation of the rotors, the inlet port 13 is closed. (FIG. 2*b*) The rotors then begin to compress the gas drawn in, represented by dots. From FIG. 2*c* it is apparent that after a further approximately 90-degree rotation of the rotors a closed compression space 21 is created which is separated from the suction space 19 just created. In FIG. 2*d*, the rotors have executed a further 90-degree rotation. The inlet port 13 is again open to the suction space 19. The compression space 21 has become smaller. Since the outlet port 14 continues to be closed, the gases in the compression space 21 are compressed. When the degree of compression is too high before the outlet port 14 is uncovered by the rotor 4 (FIG. 2*e*), the bypass valve 16 opens. With the rotors in the position shown in FIG. 2*e*, rotor 4 is about to uncover the outlet port 14 so that the gas compressed in the compression space 21 will be able to exit. FIG. 2*e* is identical with FIG. 2*a*. The cycle repeats itself.

Figure 4:
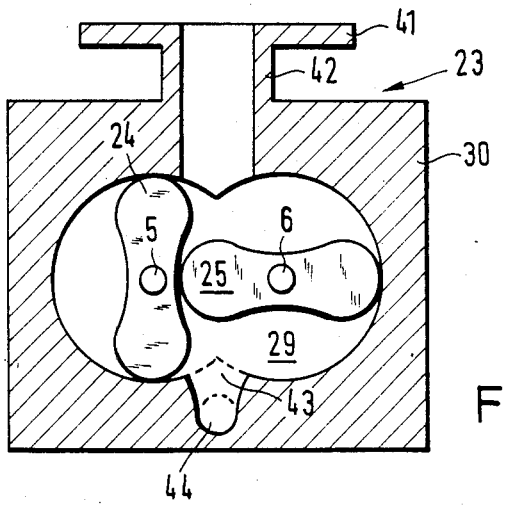
FIG. 4 is a front elevation, partly in section of the embodiment shown in FIG. 3.

The embodiment shown diagrammatically in FIG. 3 is a combination of a Roots pump 23 and a two-shaft vacuum pump constructed in accordance with the invention and generally designated 20 which serves as a backing pump. FIG. 3 is a partial longitudinal section through such a pump combination. FIG. 4 shows a cross section through the casing of the Roots pump 23.

As may be seen from FIGS. 3 and 4, the two rotors 24 and 25 of the Roots pump 23 which are disposed in the intake space 29 of the pump casing 30 are also mounted on the shafts 5 and 6 which carry the rotors 3 and 4 of the two-shaft backing pump. Shafts 5 and 6 are supported in the outer walls 26 and 27 of the two pumps by means of bearings 28 and 29. An intermediate journal bearing 31 is disposed in the partitition 32 between the two intake spaces 2 and 29 of the pumps 20 and 23. Caps 33 and 34 forming oil chambers 35 and 36 are set onto the side walls 26 and 27. The oil chambers 35 and 36 and the bearings 28 and 29 which are supplied by them with oil are separated by means of labyrinth seals 37 and 38 from the respective intake spaces 2 and 29 of the vacuum pumps. Both types of pump are able to operate without sealants, thus permitting the production of carbon-free vacuums down to the high-vacuum range.

The receiver to be evacuated is connected to a flange 41 with which a short suction pipe 42 of the Roots pump 23 is provided. The gases being moved pass through the suction pipe 42 into the intake space 29 of the Roots pump 23 and are forced by the rotors 24 and 25 through a discharge duct 43. A duct 44 connecting the discharge duct 43 of the Roots pump 23 to the inlet port 13 of the backing pump 20 is provided in the partition 32 so that the gases flowing through duct 44 are further compressed to atmospheric pressure in the backing pump 20. With sufficiently low suction pressures they exit through the outlet port 14, to which first a pipe section 45 and then an exhaust pipe 46 are connected. When supercharging occurs in the backing pump 20, the bypass valve 16, which in this embodiment is strictly weight-loaded, opens. The valve plate 17 is made sufficiently heavy for this purpose. A duct 47 which also discharges into the exhaust pipe 46 connects to the outlet port 15.

The pump combination shown in FIGS. 3 and 4 is driven by a single electric motor which engages the shafts 5 and 6 conventionally through a synchronizing transmission. Shafts 5 and 6 therefore need merely be brought out of one of the two oil caps (in the embodiment shown, out of oil cap 33). Neither transmission nor electric motor are shown since the drive is conventional and commonly used with Roots pumps. Transmission and drive motor might, of course, also be disposed on the side of the backing pump 20.

It will be appreciated that the instant specification and claims are set forth by way of illustration and not of limitation, and that various changes and modifications may be made without departing from the spirit and scope of the present invention.

What is claimed is:

1. In a two-shaft vacuum pump having an enclosed, hollow casing, an inlet port into the hollow casing, two rotors on respective parallel shafts for rotation in the hollow casing, and an outlet port in a side of the casing normal to the shafts, each rotor having at least one protruberance and at least one indentation cooperative with the other on the other rotor and the hollow casing for cylically drawing gas in the inlet and compressing it at the outlet when the shafts correspondingly rotate the rotors, whereby the location of the outlet determines a characteristic of the vacuum-pumping operation of the vacuum pump, the improvement comprising:

means for accommodating higher inlet pressures by relieving excessive compression pressures comprising a further outlet port (15) in a peripheral side of the casing parallel to the shafts and communicating with a place in the hollow casing at which the gas is compressed for the other outlet; and a pressure relief valve (16) responsive to the compressed pressure in the hollow casing and operative on the further outlet port.

2. A vacuum pump according to claim 1, and further comprising a common exhaust pipe (46) connected to both of the two outlet ports (14, 15).

3. A vacuum pump according to claim 1, wherein the inlet port (13) is disposed in a peripheral side of the casing parallel to the shafts.

4. A vacuum pump according to claim 2, wherein the inlet port (13) is disposed in a peripheral side of the casing parallel to the shafts.

5. A vacuum pump according to claim 1, wherein the inlet port (13) is disposed in a side of the hollow casing generally transverse to the shafts.

6. A vacuum pump according to claim 2, wherein the inlet port (13) is disposed in a side of the hollow casing generally transverse to the shafts.

7. A vacuum pump according to claim 1, wherein the pressure relief valve (16) is at least one of weight-and spring-loaded.

8. A vacuum pump according to claim 3, wherein the pressure relief valve (16) is at least one of weight-and spring-loaded.

9. A vacuum pump according to claim 2, wherein the pressure relief valve (16) is at least one of weight-and spring-loaded.

10. A vacuum pump according to claim 5, wherein the pressure relief valve (16) is at least one of weight-and spring-loaded.

11. A vacuum pump according to claim 1, wherein the inlet port communicates with a Roots pump (23) for the first-claimed pump to be a backing pump therefor.

12. A vacuum pump according to claim 3, wherein the inlet port communicates with a Roots pump (23) for the first-claimed pump to be a backing pump therefor.

13. A vacuum pump according to claim 2, wherein the inlet port communicates with a Roots pump (23) for the first-claimed pump to be a backing pump therefor.

14. A vacuum pump according to claim 5, wherein the inlet port communicates with a Roots pump (23) for the first-claimed pump to be a backing pump therefor.

15. A pump combination according to claim 14, wherein the Roots pump has two rotors (24, 25) and the shafts (5, 6) of the first-claimed pump are operatively associated with the rotors (24, 25) of the Roots pump (23).

16. A pump combination according to claim 11, wherein the Roots pump has two rotors (24,25) and the shafts (5, 6) of the first-claimed pump are operatively associated with the rotors (24, 25) of the Roots pump (23).

17. A pump combination according to claim 12, wherein the Roots pump has two rotors (24, 25) and the shafts (5, 6) of the first-claimed pump are operatively associated with the rotors (24, 25) of the Roots pump (23).

18. A pump combination according to claim 13, wherein the Roots pump has two rotors (24, 25) and the shafts (5, 6) of the first-claimed pump are operatively associated with the rotors (24, 25) of the Roots pump (23).

* * * * *